United States Patent [19]

Leroy et al.

[11] Patent Number: 4,469,474

[45] Date of Patent: Sep. 4, 1984

[54] AXIALLY SLIDABLE VANE MOTOR WITH VALVES IN FLUID-BASED VANES

[75] Inventors: Daniel Leroy, Limay; Laurent Gazagne, Paris, both of France

[73] Assignee: Compagnie de Construction Mechanique Sulzer, Paris, France

[21] Appl. No.: 281,735

[22] Filed: Jul. 9, 1981

[51] Int. Cl.[3] ..... F04C 2/00

[52] U.S. Cl. ..... 418/217; 418/269

[58] Field of Search ..... 418/217, 219, 230, 231, 418/232, 268, 269

[56] References Cited

U.S. PATENT DOCUMENTS

| | | | |
|---|---|---|---|
| 750,219 | 1/1904 | Von Pittler | 418/230 |
| 1,915,800 | 6/1933 | Price | 418/269 |
| 2,832,293 | 4/1958 | Adams | 418/79 |
| 3,065,709 | 11/1962 | Krawacki | 418/268 |
| 3,421,413 | 1/1969 | Adams | 418/269 |
| 3,627,456 | 12/1971 | Gerlach | 418/268 |
| 4,132,512 | 1/1979 | Roberts | 418/23 |
| 4,248,575 | 2/1981 | Watanabe | 418/269 |

*Primary Examiner*—Leonard E. Smith
*Assistant Examiner*—Jane E. Obee
*Attorney, Agent, or Firm*—Karl W. Flocks; Sheridan Neimark

[57] ABSTRACT

Hydrostatic motor with axially slidable vanes.

The invention relates to a hydrostatic motor having vanes sliding axially in rotor lodgings against a continuous stator bottom surface with recesses therein. The motor comprises an intercommunication circuit between the vanes behind the latter, said circuit permitting integral transmission of pressures between vanes depending on their variable position against said recessed stator bottom surface, the vanes retracted in their lodging acting by increase of pressure in said intercommunication circuit upon the vanes projecting out of their lodging.

7 Claims, 11 Drawing Figures

AXIALLY SLIDABLE VANE MOTOR WITH VALVES IN FLUID-BASED VANES

This invention relates to a hydrostatic motor having vanes axially slidable against a continuous stator bottom surface with recesses therein.

The device according to the invention belongs to the generation of devices developed by the Applicant, comprising slidable vanes sliding axially and disposed in rotor lodgings, said vanes being each applied in a constant and total manner to a continuous stator bottom surface which may be a cycloidal surface that can be deformed to present rectilinear zones or recesses therein adapted to the operation of the device; said recesses can also be made movable.

Rotary hydraulic machines are generally known, comprising radial slidable vanes bearing with more or less force against a peripheral surface having its generatrix parallel to the general axis of rotation. Some of said machines having radial vanes comprise a fluid chamber behind the vanes to exert pushing action on the vanes through piston means or not, said pushing action being usable for assisting springs disposed behind the pistons or behind the vanes.

The peripheral surface cooperating with the radial vanes is an ellipsoidal or circular or lobed surface having a smooth regular curve.

This invention relates more particularly to a hydrostic motor having vanes sliding axially in rotor lodgings and against a continuous recessed stator bottom surface, characterized in that it comprises an interconnection circuit between the vanes behind the latter, said circuit permitting integral transmission of pressures between vanes following their variable position against said stator bottom surface thereby ensuring acceleration and deceleration of the axial sliding motion of the vanes as well as application of the vanes against the stator bottom surface.

Valve means permit supply of pressure to said intercommunication circuit.

Each vane in its rotor lodging engages a driving piston for transmitting pressure to said intercommunication circuit.

According to one form of emobodiment of the invention, each vane is equipped with at least two valves disposed head to tail to permit hydraulic intercommunication between the bottom of the rotor lodging of the vane and a recess in the stator bottom surface.

According to another form of embodiment of the invention, each vane is comprised of at least one valve opening under the action of a magnetic stator force in the direction from the rotor lodging bottom to the stator recess and closing under the action of a spring or a recess portion in the stator bottom.

Other characteristics and advantages of this invention will appear from the following description which is made in the light of the attached drawings in which.

Figure 1:
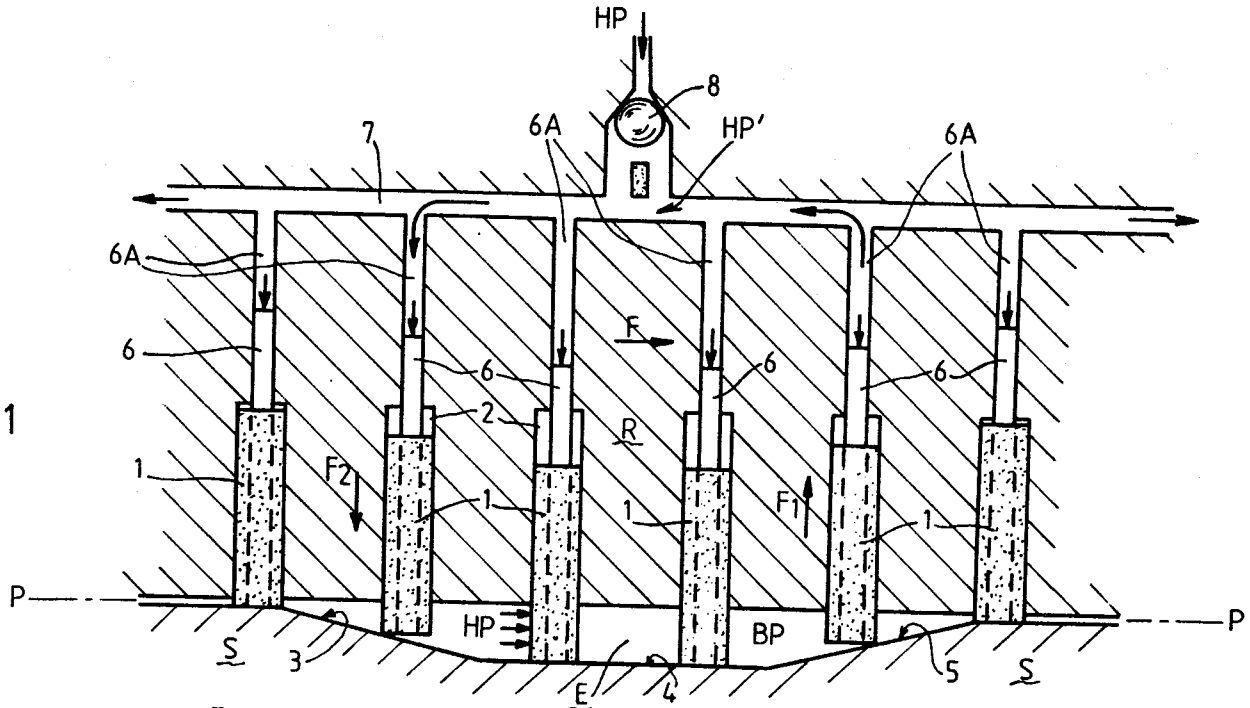
FIG. 1 is a schematic developed view of a hydrostic motor according to the invention as seen at the location of a recess of the stator bottom.

With reference to the schematized view of FIG. 1, there are shown several slidable vanes in different periods of time during their operation, said vanes 1 being each lodged in a housing 2 formed in a rotor R with respect to a stator bottom S comprising recesses therein one E of which presents, with respect to an interstitial plane P between rotor and stator, and with respect to a rotor motion F, a ramp 3 geometrically moving apart from said plane, a zone 4 parallel to said plane and a ramp 5 geometrically coming nearer to said plane.

Each vane 1 in its lodging engages a driving piston 6 disposed in a channel 6A communicating with an auxiliary circuit 7 formed in the rotor. All channels 6A communicate with said auxiliary circuit 7 so that they all communicate with each other.

In accordance with the developed sketch of FIG. 1 relative to the behavior of the slidable vanes as a function of a single recess E, due to the rotor movement F, the slidable vane 1 retracts upon contacting ramp 5 which geometrically moves toward the interstitial plane P. Due to said retraction the respective vane 1 communicates a supplementary pressure by means of its driving piston 6 into the auxiliary circuit 7. Said pressure acts behind the driving piston 6 of the other vanes, in particular, those having their forward nose in contact with the ramp 3 which moves geometrically away from the interstitial plane P and out of their lodging 2 in view of the rotor motion F. The pressure in the auxiliary circuit 7 also acts in particular upon the slidable vanes lying in an active zone of operation of recess E where the zone 4 of the recess is parallel to the interstitial plane P between rotor and stator.

Therefore there is always a retracting vane when there is an active vane projecting out of its lodging. Such action of the pistons of the retracted vanes upon the vanes projecting out of their lodging may be sufficient to maintain satisfactory application or pressing of the vanes against the continuous recessed stator bottom surface of the device.

The auxiliary circuit 7 is supplied with high pressure HP through a valve 8 and during operation the pressure reigning in the auxiliary circuit 7 is pressure HP' higher than pressure HP. In other terms, $HP' = HP + Fl/S$; Fl being the driving force of the coming in vane and S the active surface of the driver 6 for transmission of pressure. The application force F2 of the vane projecting out of its lodging is equal to pressure F1.

Figure 2:
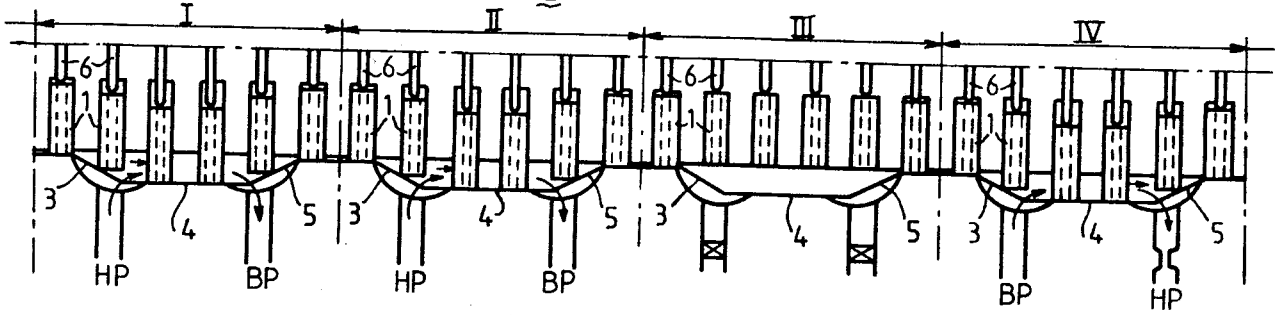
FIG. 2 is a developed view of a hydrostatic motor according to four stator bottom recesses and four phases of operation.

FIG. 2 shows four different phases of operation I, II, III and IV. Phases I and II are propulsion phases with a HP inlet and a BP outlet for each recess. Phase III corresponds to a free running operation with closed inlet and outlet and phase IV represents a possible braking or pumping operation with low pressure BP and high pressure HP circuits.

In the forms of embodiments of FIGS. 3 to 10 each vane 1 is provided with a single effect driving piston 6 with spring 9 to drive the vane up to the engagement thereof with ramps 3 or 5 or the zone 4 of each recess E of the continuous stator bottom surface.

The driving force conjointly results from the spring 9 and a hydraulic pressure from the high pressure HP held in pressure by a valve 10 communicating through a channel 11 with the auxiliary circuit 7.

Upon rotation of the motor the ramps 5 which geometrically come nearer to the interstitial plane P press upon the vanes engaged therewith causing retraction of the vanes into their lodging 2 and consequently, increased pressure in the auxiliary circuit, transmitted by the drivers 6 so that HP' is higher than HP.

Pressure HP' then presses upon the other vanes to thereby maintain them applied against the stator bottom surface to permit acceleration of the vanes projecting out of their lodging. The vanes are hydraulically connected between one another and can no longer move away.

Each vane is provided with two valves 12 and 13 disposed head to tail and permitting hydraulic intercommunication between the bottom of lodging 2 and the recess E of the stator bottom surface.

On the start, pressure HP arriving in the recess E opens the intercommunication valve 12 and the valve 10 of the auxiliary circuit 7 of the drivers.

Figure 3:
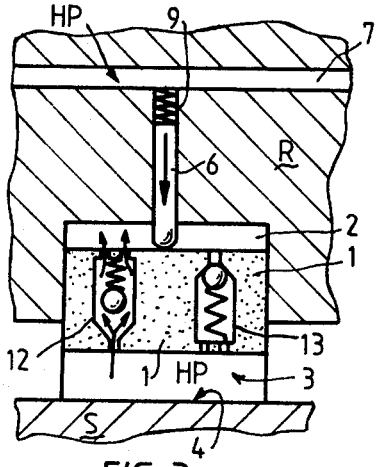
FIGS. 3 and 4 are front and profile views respectively, of a slidable vane of a motor according to the invention, at the location of a recess ramp geometrically moving apart from an interstitial plane between the rotor and stator.
Figure 4:
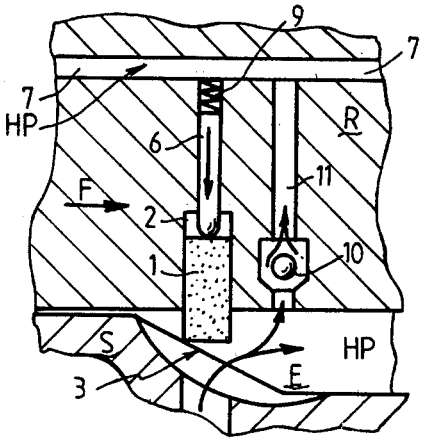

With reference to FIGS. 3 and 4, the vane comes to bear under the action of the spring 9 against the ramp 3 which geometrically moves away from the interstitial plane P.

Figure 5:
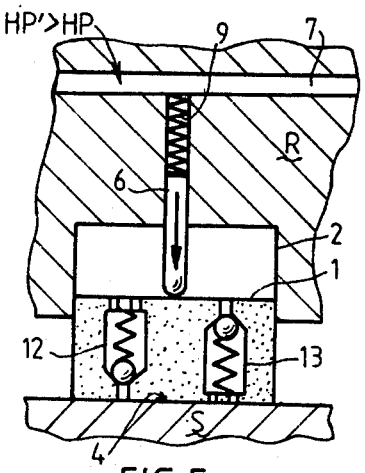
FIGS. 5 and 6 are front and profile views respectively of a slidable vane of a motor according to the invention at the location of a recess zone parallel to the interstitial plane between rotor and stator.
Figure 6:
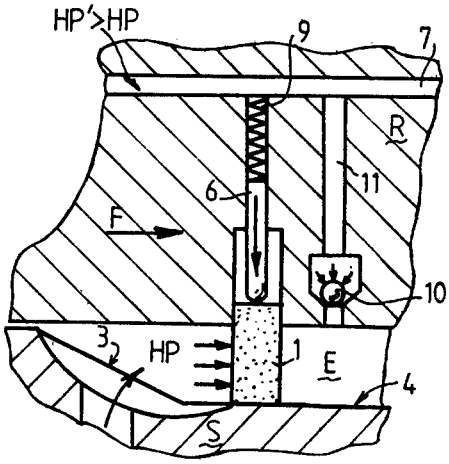

With reference to FIGS. 5 and 6, the vane is seen in its active phase. The forward nose of the vane engages the zone 4 of the stator bottom which is parallel to the interstitial plane P. Due to this position of the vane, the valves 12 and 13 are closed and the vane presses against the stator zone through the action of its driver 6.

Pressure HP' which is then present in the auxiliary circuit 7, due to the increase of pressure from vanes retracted elsewhere is higher than pressure HP and closes the intercommunication valve 10 between said auxiliary circuit and the recess E.

Figure 7:
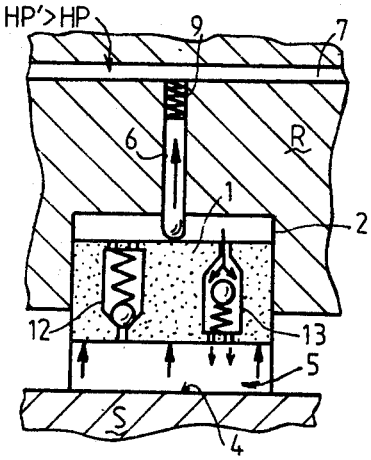
FIGS. 7 and 8 are front and profile views respectively of a slidable vane of a motor according to the invention at the location of a stator bottom ramp geometrically coming closer to the interstitial plane between rotor and stator.
Figure 8:
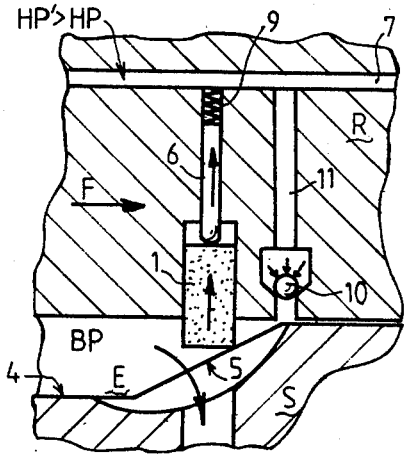
Figure 9:
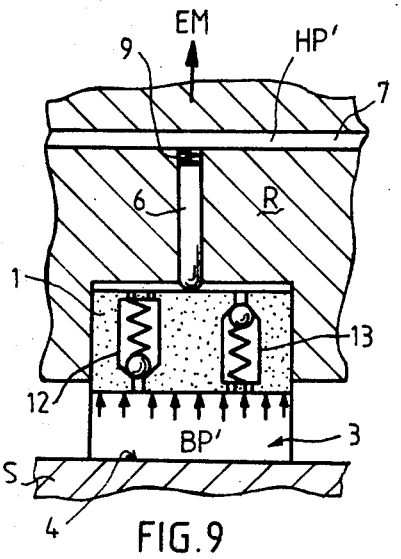
FIGS. 9 and 10 are front and profile views respectively of a slidable vane of a motor according to the invention, in which the stator bottom recess is out of operation for providing free running operation.
Figure 10:
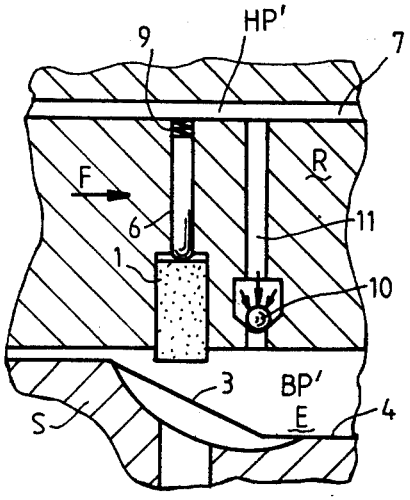

With reference to FIGS. 7 and 8, the vane 1 is shown engaged with ramp 5 which geometrically comes nearer to the interstitial plane such that under the action of said ramp the vane returns into its lodging thereby opening the intercommunication valve 13 between the bottom of lodging 2 of the vane and the recess E. Under these conditions the recess E is brought to low pressure BP hydraulic discharge. With reference to FIGS. 9 and 10 the pressure in recess E corresponds to the relation: BP' smaller than BP smaller than HP, so that it cannot open the intercommunication valve 12. Then it opposes a zero pressure behind the vane. The vane cannot come down and the recess E is out of operation thereby resulting in a free rotation operation. The action from an electromagnet EM can be used for contributing to the maintaining of the vane in total retraction in its lodging.

Figure 11:
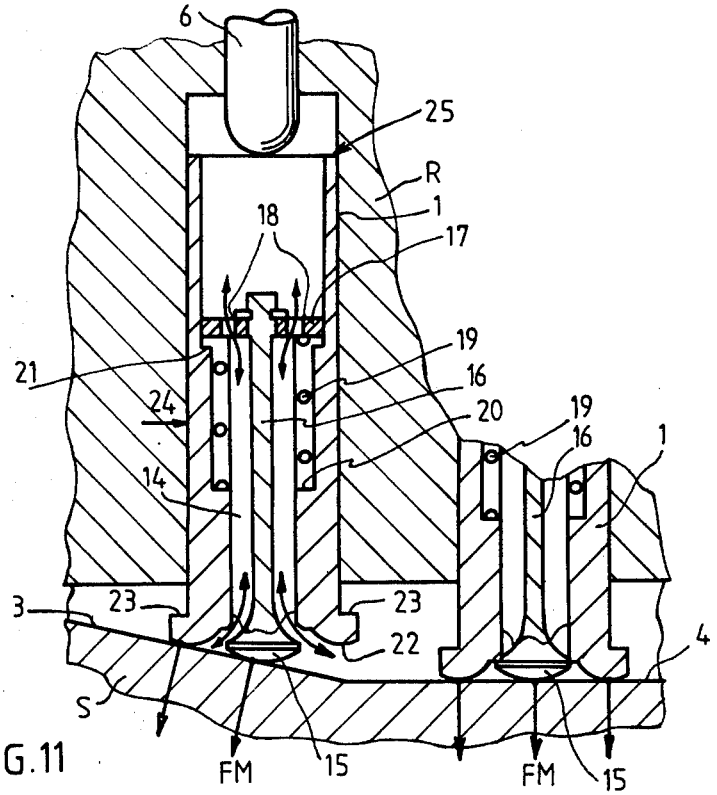
FIG. 11 is a view according to another form of embodiment of a slidable vane in cross-section and partial cross-section at two points in time during the operation thereof.

In the form of embodiment shown on FIG. 11 the vane is provided with one or more valves arranged in the same direction. A magnetic force FM from the stator causes application of the vane against the continuous stator bottom surface and the opening and closing of the valve denoted generally by reference numeral 14 as a function of the position of the vane with respect to ramps 3 and 5 and the zone 4 of the stator recess E, since the head 15 of said valve which is itself attracted through the magnetic force FM is also caused to come into contact with ramps 3 and 5 and the zone 4.

During the active phase of high pressure the valve is closed and behind the vane shuts up a hydraulic volume which prevents the latter from moving off. The magnetic force FM may then not be exerted thereon.

The head 15 of the valve is made integral with a rod 16 carrying a disk 17 having opening 18 therein. A spring 19 is interposed between the disk 17 and an annular bottom 20 formed in the vane. Moreover, the disk 17 may come into abutment against an annular shoulder 21 also formed in the vane.

In the starting position, a hydraulic pressure from the auxiliary circuit 7 causes actuation of the vanes.

In all forms of embodiment the vanes may have a curved portion 22 for engagement with the continuous stator surface and compensatory portion 23 exposed to fluid pressure in such a way that said pressure is exerted substantially perpendicular to the stator surface thereby improving the application of the vane against the stator surface. Each vane can also be provided with a supplementary surface exposed to pressure and extending laterally of the vane at 24 and continuing within the lodging of the vane. Such supplementary surface prevents any tipping over of the vane and seals the latter against its lodging on a line of contact 25 lying in a rearward edge of that lateral face of the vane opposed to that exposed at 24 to the dominating pressure.

It will be understood that this invention was only described and represented in preferential forms of embodiment and that equivalent parts can be substituted for its constituents without departing from its scope as defined in the appended claims.

We claim:

1. A hydrostatic motor of the axially slidable vane variety comprising a stator and a rotor, said rotor being formed with a plurality of vane housings, a vane mounted in each of said rotor housings for sliding motion therein axially of said motor, an auxiliary fluid circuit formed in said rotor interconnecting all of said vane housings together on the back sides thereof between the back of each said vane and the respective bottom of each said housing, a main fluid circuit between said stator and the front ends of all of said vanes, valve means interconnecting said auxiliary and main fluid circuits to permit a flow of fluid in one direction only from said main circuit to said auxiliary circuit, each said vane being provided with valve means therein to permit controlled flow in both directions between said main circuit at the front of said vanes and the space within each vane housing behind each said vane therein, and said vane valve means being operable upon each stroke of each said vane within its rotor housing.

2. A hydrostatic motor according to claim 1, wherein said vane valve means comprises two springed valves disposed inside each of said vanes alongside one another and opening in opposed directions.

3. A hydrostatic motor according to claim 1, each said vane including driving piston means provided in said auxiliary fluid circuit to assist in the motion of each said vane in its housing in said rotor.

4. A hydrostatic motor according to claim 3, and spring means for urging each said vane outwardly with respect to its housing in said rotor towards said stator.

5. A hydrostatic motor according to claim 1, wherein each said vane at the front end thereof is formed with a curved surface for cooperation with surfaces of said stator during operation of said motor, and said front ends of said vanes also being formed with a pressure receiving surface exposed to the pressure in said main fluid circuit to assist in the motion of said vane within its rotor housing.

6. A hydrostatic motor according to claim 1, and means for providing magnetic force to selectively maintain said vanes completely retracted in their respective housings in said rotor in order to obtain free running operation of said motor.

7. A hydrostatic motor according to claim 1, comprising a magnetic stator means and wherein said vane valve means comprises one springed valve disposed inside each of said valves, said valve being disposed so as to open under the action of said magnetic stator means in the direction from said housing to one of said recesses and closing under the action either of said spring of said valve or of a portion of one of said recesses.

* * * * *

UNITED STATES PATENT AND TRADEMARK OFFICE

CERTIFICATE OF CORRECTION

PATENT NO. : 4,469,474

DATED : September 4, 1984

INVENTOR(S) : Daniel LEROY; Laurent GAZAGNE

It is certified that error appears in the above—identified patent and that said Letters Patent is hereby corrected as shown below:

Please correct the Assignee [73] to read:

-- Compagnie de Construction Mecanique Sulzer
Paris, France --

Signed and Sealed this

*Twenty-sixth* Day of *February 1985*

[SEAL]

*Attest:*

DONALD J. QUIGG

*Attesting Officer* *Acting Commissioner of Patents and Trademarks*